US006158354A

United States Patent [19]

Eiraku

[11] Patent Number: 6,158,354

[45] Date of Patent: Dec. 12, 2000

[54] ROLLER COASTER

[75] Inventor: Masahide Eiraku, Osaka, Japan

[73] Assignee: Hoei Sangyo Co, Ltd., Osaka, Japan

[21] Appl. No.: 09/028,348

[22] Filed: Feb. 24, 1998

[30] Foreign Application Priority Data

Mar. 1, 1997 [JP] Japan ..... 9-062505

[51] Int. Cl.[7] ..... A63G 1/00

[52] U.S. Cl. ..... 104/53; 104/57; 104/63

[58] Field of Search ..... 104/53, 55, 57, 104/63, 74, 75, 76

[56] References Cited

U.S. PATENT DOCUMENTS 4,170,943 10/1979 Achrekar ..... 104/75

5,791,254 8/1998 Mares et al. ..... 104/53

*Primary Examiner*—S. Joseph Morano

*Assistant Examiner*—Robert J. McCarry, Jr.

*Attorney, Agent, or Firm*—Bacon & Thomas, PLLC

[57] ABSTRACT

A roller coaster device which can operate a seat together with a car to perform a perpendicular running motion such as vertical descent, vertical ascent, vertical spiral motion and the like, or in such a manner as to run backwards. The device significantly increases thrill and interest levels by creating the sensation that the endless running rail suddenly disappears from the view of the occupants in the roller coaster device. The device can be configured in a small space and in a compact manner. A car (4) is mounted on the endless running rail (1) having a desired length that is provided in a rolling and bending manner through rollers (6) so as to run freely while being held thereto, and seats (11*a,* 11*b*) are suspended on the car 4 by mounting members (12*a,* 12*b*) so as to rotate freely.

6 Claims, 8 Drawing Sheets

ROLLER COASTER

BACKGROUND OF THE INVENTION

1. Field of the Invention

The present invention relates to a roller coaster for an amusement park and the like and used therein.

2. Description of the Related Art

Conventionally, in a roller coaster of this kind, a car with a seat, is mounted on an endless running rail provided in a rolling and bending manner through a desired number of rollers so as to run freely while being held thereto, or a structure in which a car with a seat is suspended to the endless running rail through a desired number of rollers so as to run freely while being held thereto.

And, in the conventional embodiment having the above structure, while the car runs along the endless running rail at high and low speeds , steep slope descent, steep slope ascent, somersault, screw rotation or the like are repeated so that a weightlessness feeling and a thrill from a change in acceleration, centrifugal force and gravity enhances the sensations of the riders corresponding to an increased interest in the roller coaster.

However, in the conventional embodiment, the seat is generally fixedly mounted to the car, the seat runs together with the car in one united body during running, so that a large amount of centrifugal force, gravity, the change in acceleration or the like are directly applied thereto and a compulsory external force is acted thereon. Accordingly, in view of strength, securing safety for an occupant and the like, during running only an acute running operation such as steep slope descent, steep slope ascent, somersault, screw rotation and the like can be performed, but a perpendicular running operation such as vertical descent, vertical ascent, vertical spiral motion and the like cannot be actually performed, much less backward running, so that the roller coaster can not always give satisfactory thrill, interest and the like. Further, as mentioned above, since the seat is run and operated together with the car at an acute angle, not only is the endless running rail extending for a long distance so that a great space is required for disposing the endless running rail, but also the total course becomes longer so that the cost therefor tends to increase.

SUMMARY OF THE INVENTION

An object of the present invention is to provide a roller coaster which can solve all the conventional problems, and can operate not only a seat together with a car in such a manner as to perform a perpendicular running motion such as vertical descent, vertical ascent, vertical spiral motion and the like, but also with the seat in such a manner as to run backward, so as to significantly increase a thrill and an interest such that the endless running rail suddenly disappears from a view of the occupant and the like; and further can be disposed in a small space in a compact manner.

Accordingly, in accordance with the present invention, there is provided a roller coaster in which a car 4 is mounted on an endless running rail 1 of a desired length provided in a rolling and bending manner through rollers 6 so as to freely run while being held thereto, and seats 11*a* and 11*b* are suspended on the car 4 through desired mounting members 12*a* and 12*b* so as to rotate freely.

And, in the roller coaster in accordance with the present invention, the seats 11*a* and 11*b* are suspended to the car 4 so as to rotate freely, when the compulsory external force such as a great amount of centrifugal force and gravity or the change in the acceleration during running are applied, the seats 11*a* and 11*b* are rotated by the external force, so that the external force can be significantly decreased. Accordingly, a perpendicular running operation such as vertical descent, vertical ascent, vertical spiral motion and the like which are deemed to be impossible in the conventional art can be smoothly performed, and the seats 11*a* and 11*b* can be operated to run backwards by rotation and inverse operation.

DESCRIPTION OF THE PREFERRED EMBODIMENT

Figure 1:
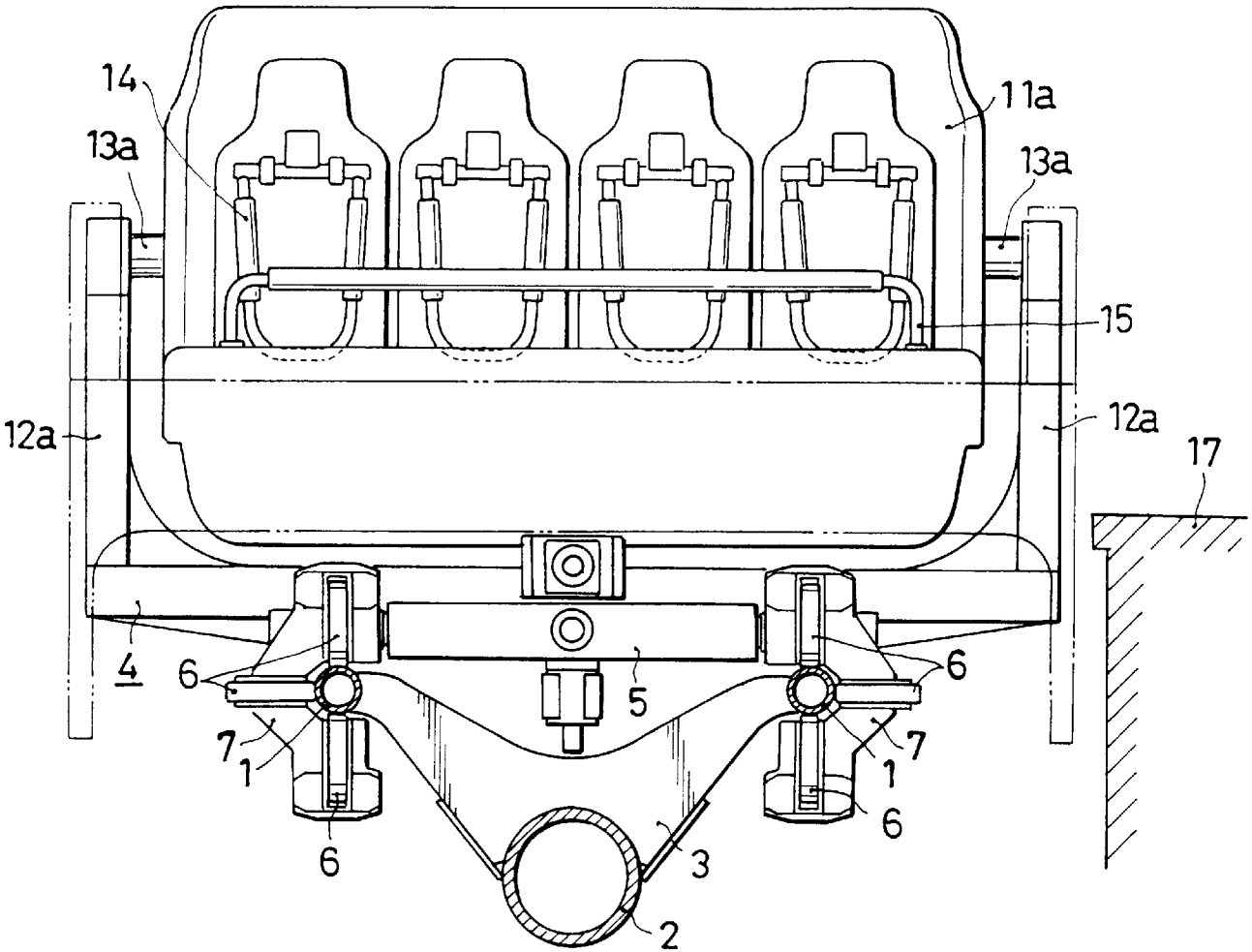
FIG. 1 is a front elevational view which shows an embodiment in accordance with the present invention.
Figure 2:
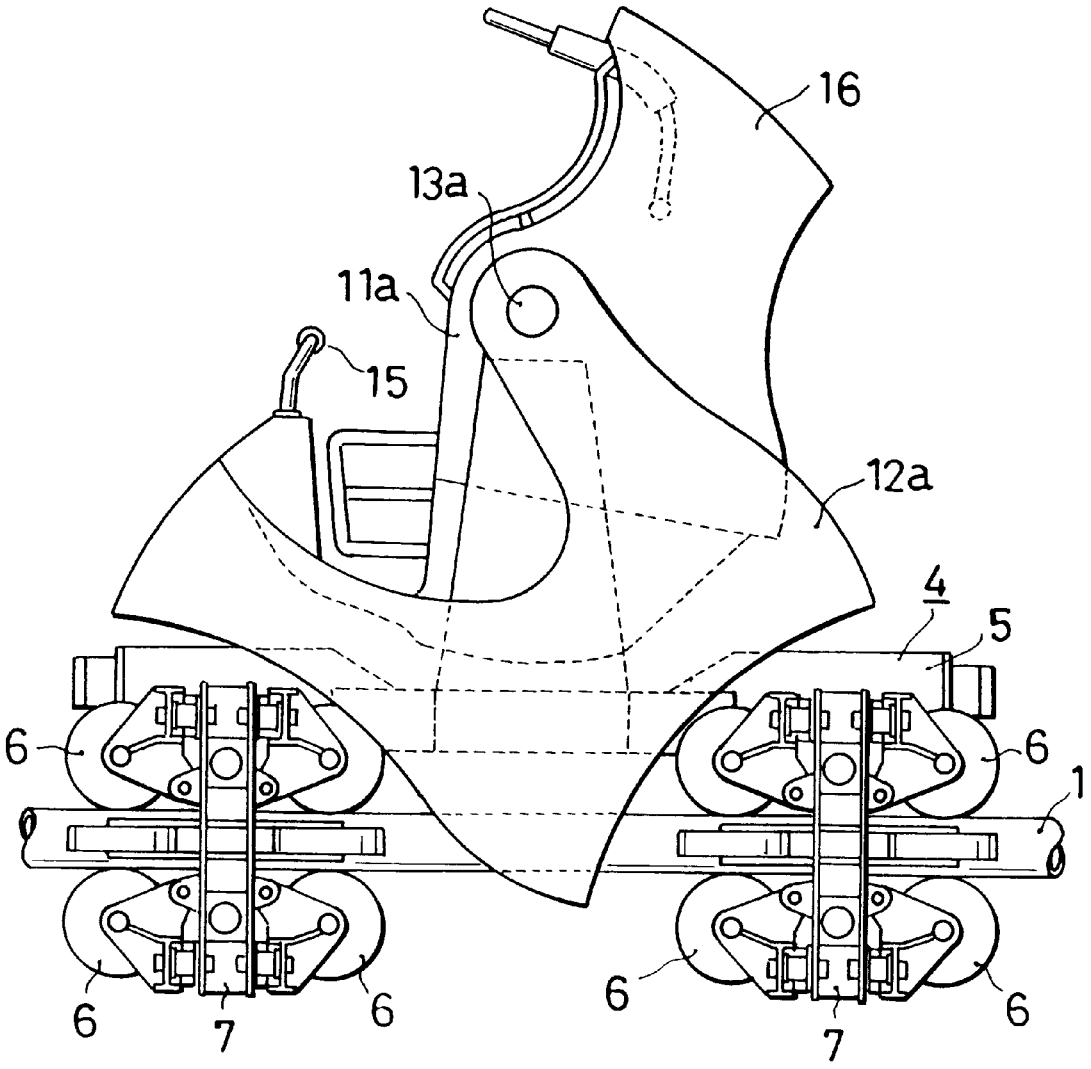
FIG. 2 is a side elevational view of the same.
Figure 3:
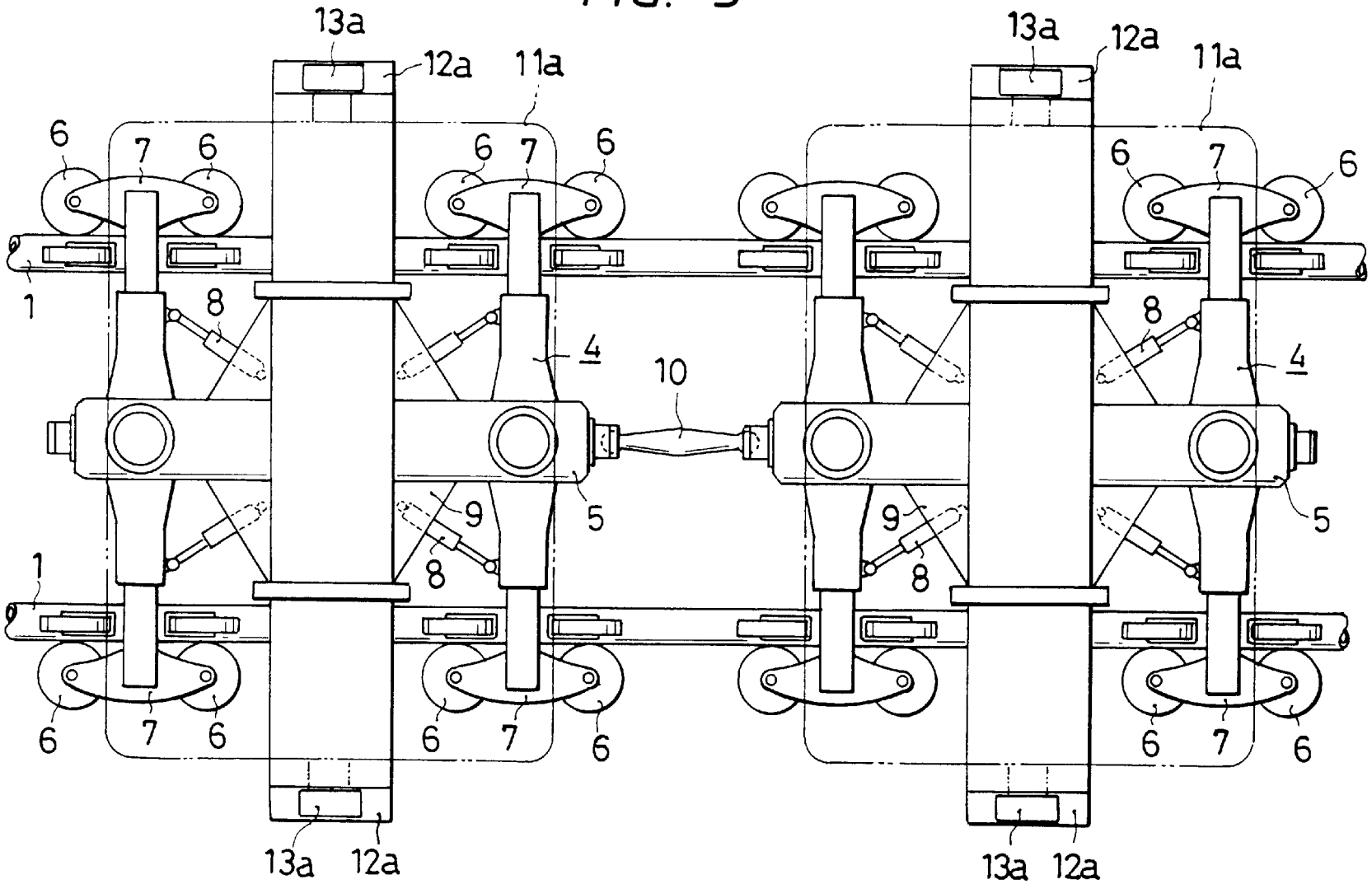
FIG. 3 is a plan view which shows a car 4 of the same.

An embodiment in accordance with the present invention will be described below with reference to the attached drawings.

FIGS. 1 to 4 show an embodiment of the present invention, in the drawing, reference numeral 1 denotes a pair of endless running rails constituted by a pipe, disposed on both sides, structured in a rolling and bending manner at a desired angle and having a desired length, and the endless running rail 1 is provided in a holding body 2 constituted by a pipe through a mounting bracket 3 having a substantial V shape in an overhead manner. Reference numeral 4 denotes a car disposed in the endless running rail 1 so as to run freely while being held thereto, reference numeral 5 denotes a frame having a substantial H shape, constituting the car 4 and formed in a manner of a revolving pair, reference numeral 6 denotes a pair of rollers, three such pairs each being mounted to each of four corners of the frame 5 by mounting member 7 so as to be held to the endless running rail 1, and reference numeral 8 denotes four oil dampers radially disposed from a center of the frame 5 through a mounting plate 9, the oil damper 8 being structured so as to minimize vibration due to a lack of uniformity of the running surface of the endless running rail 1 and to reduce irregular vibration of the roller 6, thereby improving a contact performance of the roller 6 with respect to the endless running rail 1 and improving a running performance. Reference numeral 10 denotes a connecting member for connecting the cars 4 to each other, reference numeral 11*a* denotes a desired seat rotatably disposed on the car 4 through a pair of mounting members 12*a* disposed on both sides of the car 4 and each having a substantial U shape, the seat 11*a* being axially attached to the mounting member 12*a* through a mounting shaft 13*a* in a suspended manner so as to lower its center of gravity. Reference 14 denotes a supporting device for an occupant mounted in the seat 11*a,* reference numeral 15 denotes a handrail having an inverted and downward directing shape and disposed in front thereof, and reference numeral 16 denotes a cover member for protection axially attached to an upper end of the mounting member 12*a* in such a manner as to rotate freely. In addition, reference numeral 17 denotes a platform attached to the endless running rail 1.

Next, an operation of the embodiment having the above structure will be described below.

At first, the car 4 is connected to each other by the connecting member 10 so that a desired car formation is obtained. Thereafter, while initially operating to run the car 4 by a desired drive device such as a chain conveyor, the car 4 is operated to run along the endless running rail 1 to a direction shown by arrows in FIG. 4, so that a running operation such as vertical descent, vertical ascent, vertical spiral motion, screw rotation and the like is performed. At this time, since the seat 11*a* is axially attached to the car 4 in such a manner as to freely rotate, the seat 11*a* is suitably rotated by the centrifugal force and the gravity at a time of running of the car 4 or the change in the acceleration, so that such an external force can be reduced.

Figure 4:
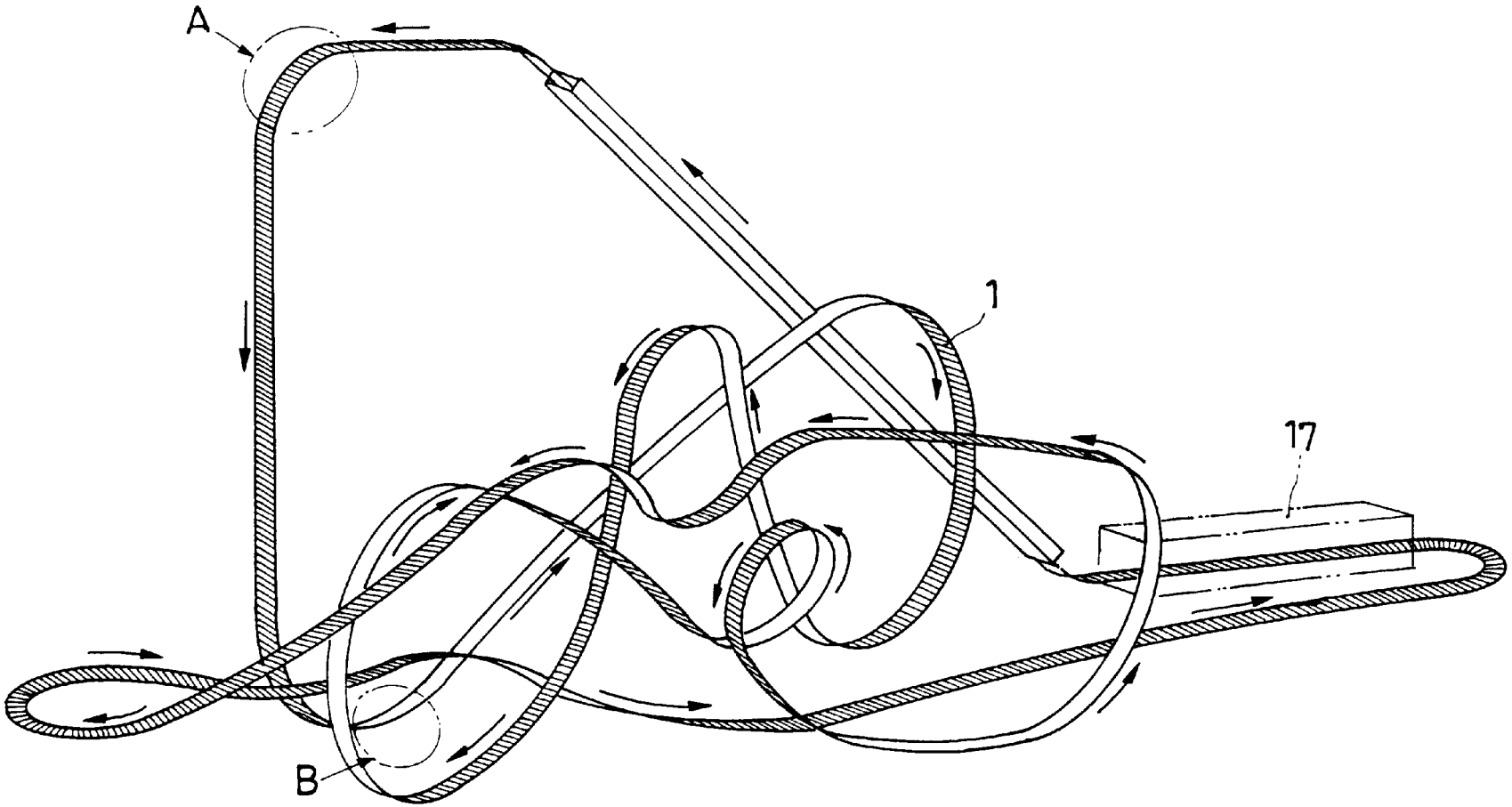
FIG. 4 is a schematic view which shows a state of disposing an endless running rail 1 of the same.
Figure 5:
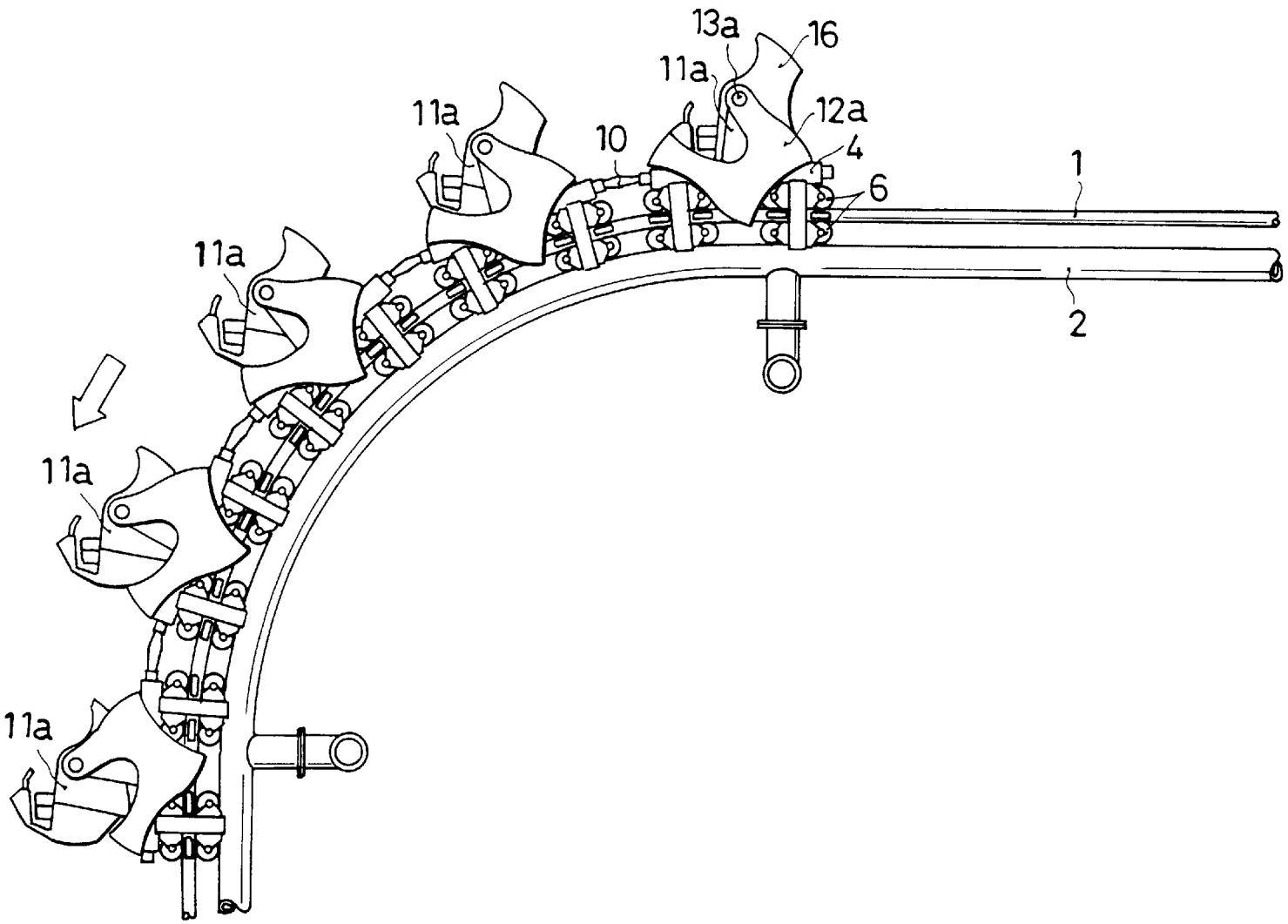
FIG. 5 is a partially enlarged side elevational view which shows an operating state of a seat 11*a* at an A point on the endless running rail 1 of the same.
Figure 6:
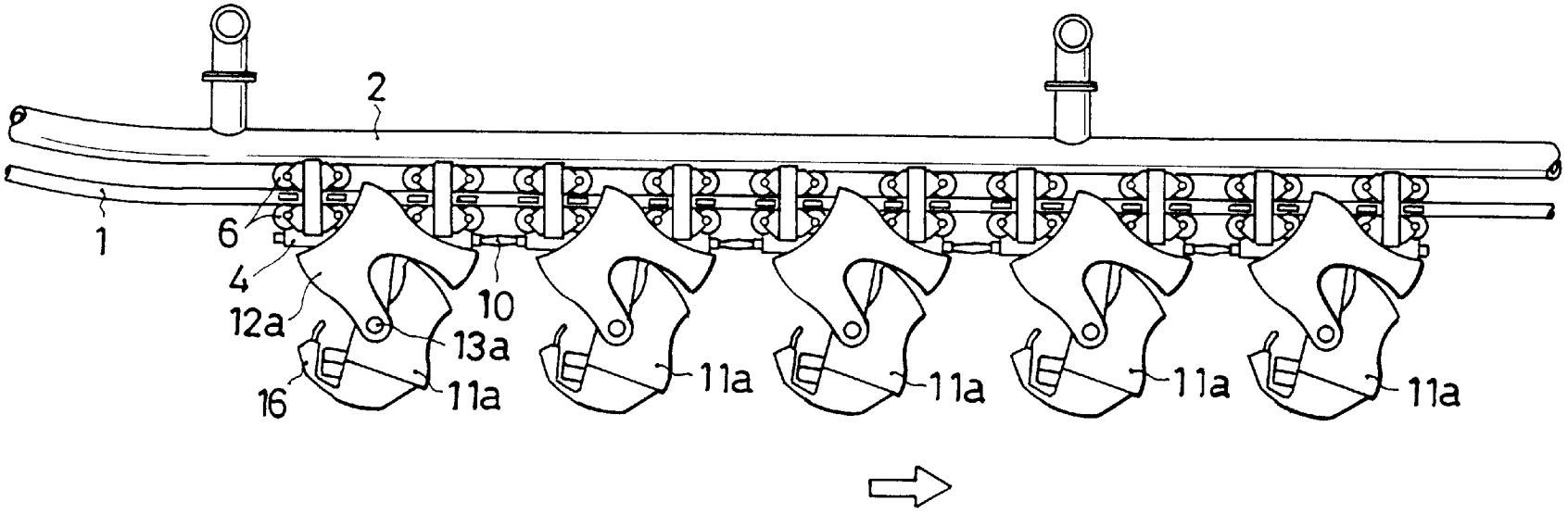
FIG. 6 is a partially enlarged side elevational view which shows an operating state of a seat 11*a* at a B point on the endless running rail 1 of the same.

For example, at a time of vertically descending toward a B point from an A point in the endless running rail 1 shown in FIG. 4, the car 4 vertically runs along the endless running rail 1 but the seat 11*a* gradually receives the external force due to the centrifugal force, the gravity and the change in acceleration in correspondence to the vertical running so as to be rotated through the mounting shaft 13*a* in an inverted manner. Then, not only can the external force be efficiently reduced, but also the seat 11*a* passes through the B point in an inverted state, so as to run in a so-called backward state (refer to FIGS. 5 and 6).

Further, similarly, also at a time of the vertical ascent, the vertical spiral motion, the somersault and the screw rotation of the car 4, the seat 11*a* is suitably rotated at a desired angle without opposing to the external force such as the compulsory centrifugal force, gravity and the like, thereby reducing the external force and being smoothly operated to run. Then, the car 4 is stopped when arriving at the platform 17 while being operated to run, so that the car 4 is stopped at a predetermined place.

Figure 7:
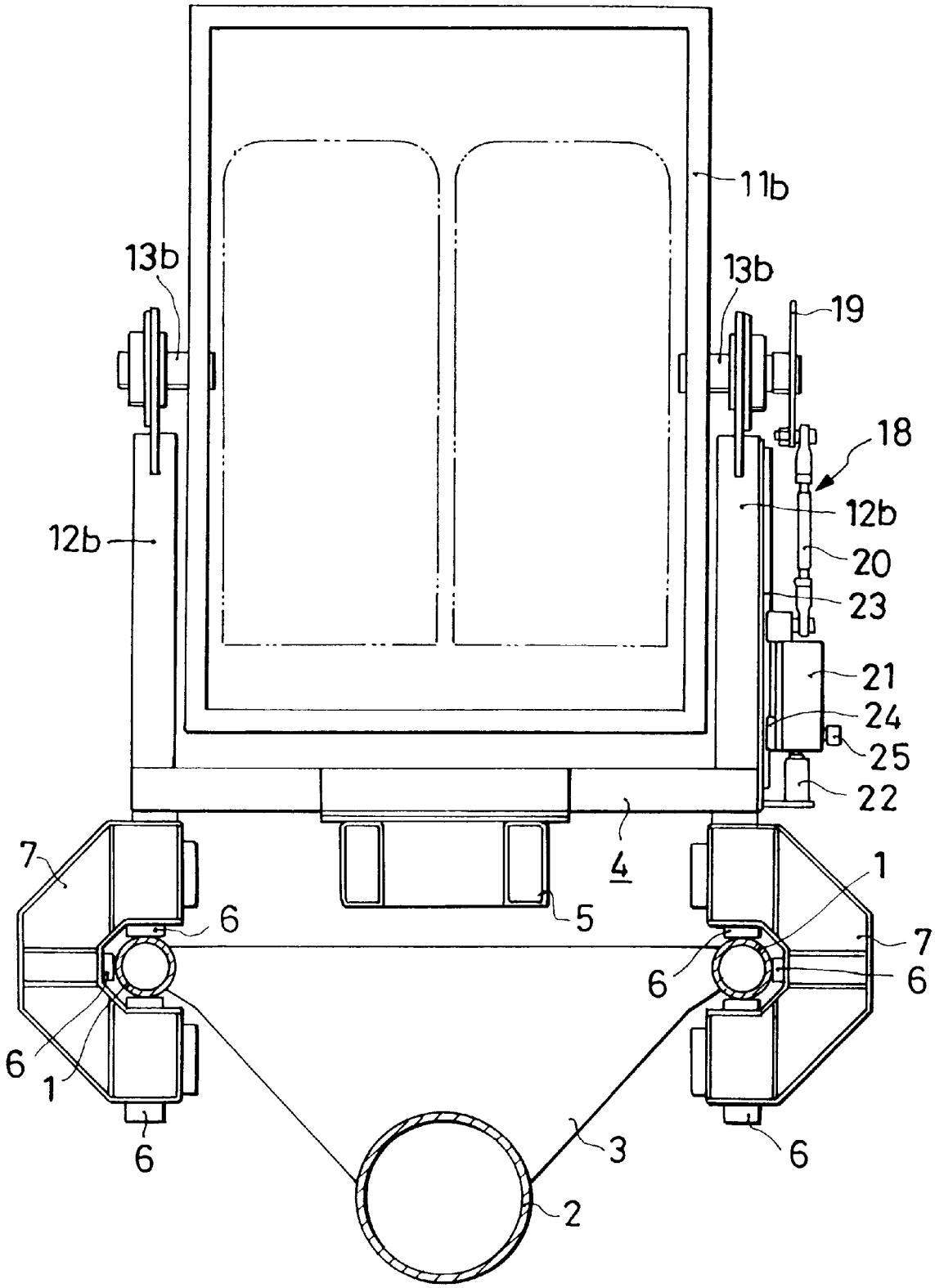
FIG. 7 is a front elevational view which shows another embodiment.
Figure 8:
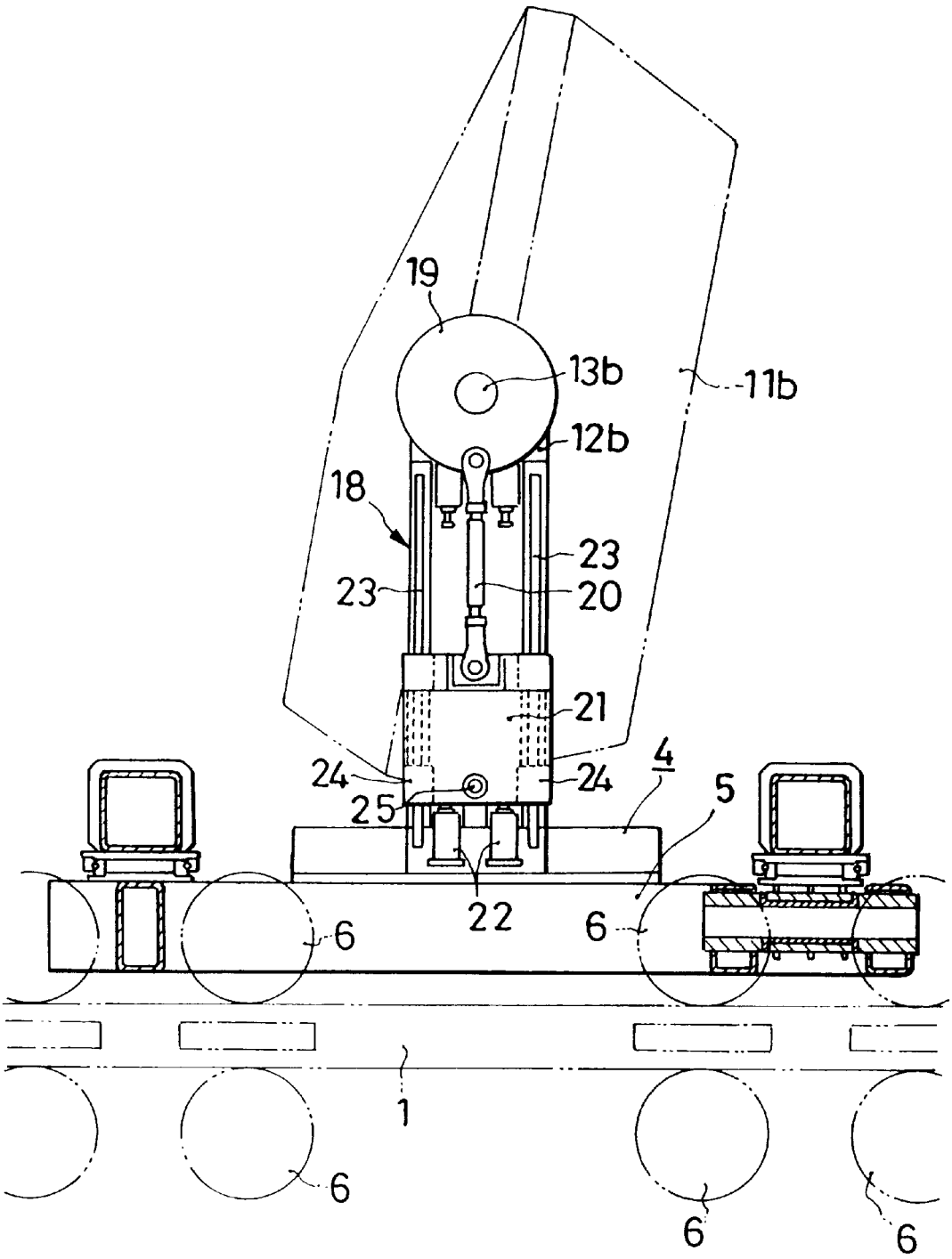
FIG. 8 is a side elevational view of the same.

FIGS. 7 and 8 show another embodiment of the present invention, in this drawing, reference numeral 12*b* denotes a mounting member having a square shape and standing in both sides of the car 4, reference numeral 11*b* denotes a seat suspended between the mounting members 12*b* on both sides through a mounting shaft 13*b* in such a manner as to freely rotate, the seat 11*b* being structured such that a position of a center of gravity is set slightly higher than that of the embodiment mentioned above. Reference numeral 18 denotes a damping device attached so as to suitably reduce and control an impact at a time of rotation of the seat 11*b*, and the damping device 18 is comprised of a a crank disc 19 fixedly attached to 13*b* of the mounting shafts, a counter weight 21 connected to the crank disc 19 through a crank rod 20 and a shock absorber 22 connected to the counter weight 21. Reference numeral 23 denotes a pair of guide rails disposed on both sides and vertically guiding the counter weight 21 through a guide piece 24, and reference numeral 25 denotes a vibration reducing roller attached to the counter weight 21. The other structures are the same as those of the embodiment mentioned above, and the same reference numerals denote the same elements.

In the embodiment having the above structure, as in the same manner as that of the preceding embodiment, while operating the car 4 in such a manner as to run along the endless running rail 1, the seat 11*b* is suitably rotated, thereby efficiently reducing the external force such as the centrifugal force and the like without opposition thereto, so that vertical descent, vertical ascent, vertical spiral motion, somersault and screw rotation can be performed. At this time, the damping device 18 can suitably decrease and control the impact at a time of rotation in correspondence to the external force acted on the seat 11*b* such as the centrifugal force and the external force and a smooth running operation can be obtained.

In the above embodiment, the seats 11*a* and 11*b* are rotatably suspended on the car 4 which is mounted on the endless running rail 1 in such manner as to run freely while being held thereto through the mounting members 12*a*, and 12*b*, the structure is not limited to the disclosure above, and the seats 11*a* and 11*b* may be rotatably suspended to the car 4 through the desired mounting member as well as the car 4 being suspended on the endless running rail 1 so as to run freely while being held thereto. Further, the damping device 18 is not limited to the structure mentioned above, and other known damping devices can be suitably employed and used.

In accordance with the present invention, since the car 4 is mounted on the endless running rail 1 of a desired length provided in a rolling and bending manner through the rollers 6 so as to run freely while being held thereto, and the seats 11*a* and 11*b* are suspended to the car 4 through the desired mounting members 12*a* and 12*b* so as to rotate freely, when the compulsory external force such as a great amount of centrifugal force and gravity or the change in the acceleration during running is applied, the seats are rotated by the external force, so that the external force can be significantly decreased. Accordingly, a perpendicular running operation such as vertical descent, vertical ascent, vertical spiral motion and the like which are deemed to be impossible in the conventional art can be smoothly performed, and the seats 11*a*, 11*b* can be operated to run backward by rotating and inverse operation. Accordingly, in comparison with the conventional embodiment, the thrill, interest and the like can be significantly improved, and further the total course can be made compact to fit within a small space.

What is claimed is:

1. A roller coaster device comprising:

a car (4) mounted on an endless running rail (1) having a determined length and configured to provide rolling and bending motion for the car (4);

rollers (6) connected to the car (4) and configured to run freely along the rail (1) while being held securely thereto;

the car (4) including one or more seats (11*a*, 11*b*) that is suspended on a mounting shaft (13*a*, 13*b*) that is secured to a mounting member (12*a*, 12*b*) that is attached to the car (4) such that the seat (11*a*, 11*b*) is free to rotate on the mounting shaft (13*a*, 13*b*);

the mounting shaft (13*a*, 13*b*) spaced apart from the endless running rail (1) by a determined distance in a vertical direction perpendicular to the rail (1) with respect to the ground; and the seat (11*a*, 11*b*) rotated such that its center of gravity will be positioned lower than the mounting shaft (13*a*, 13*b*) in a direction perpendicular to the rail (1) with respect to the around.

2. A roller coaster device as claimed in claim 1, further comprising a damping device (18) configured between the mounting shaft (13*b*) and the mounting member (12*b*).

3. A roller coaster device as claimed in claim 2, wherein the damping device (18) includes a crank disc (19) fixedly attached to the mounting shaft (13*b*), a counter weight (21) connected to the crank disc (19) through a crank rod (20) and a shock absorber (22) connected to the counterweight (21).

4. A roller coaster device comprising:

a car (4) mounted on an endless running rail (1) having a determined length and configured to provide rolling and bending motion for the car (4);

rollers (6) connected to the car (4) and configured to run freely along the rail (1) while being held securely thereto;

the car (4) including one or more seats (11*a,* 11*b*) that is suspended on a mounting shaft (13*a,* 13*b*) that is secured to a mounting member (12*a,* 12*b*) that is attached to the car (4) such that the seat (11*a,* 11*b*) is free to rotate on the mounting shaft (13*a,* 13*b*);

the mounting shaft (13*a,* 13*b*) spaced apart from the endless running rail (1) by a determined distance in a vertical direction perpendicular to the rail (1) with respect to the ground;

the seat (11*a,* 11*b*) secured to the mounting member such that its center of gravity will be positioned lower than the mounting shaft (13*a,* 13*b*) in a direction perpendicular to the rail (1) with respect to the ground; and the car (4) and the rail configured such that an occupant seated on the seat (11*a,* 11*b*) has a field of vision that is not obstructed by the rail (1) including its supporting structure.

5. A roller coaster device as claimed in claim 4, further comprising a damping device (18) configured between the mounting shaft (13*b*) and the mounting member (12*b*).

6. A roller coaster device as claimed in claim 5 wherein the damping device (18) includes a crank disc (19) fixedly attached to the mounting shaft (13*b*), a counter weight (21) connected to the crank disc (19) through a crank rod (20) and a shock absorber (22) connected to the counter weight (21).

* * * * *